US011497300B2

(12) United States Patent
Kitzer

(10) Patent No.: US 11,497,300 B2
(45) Date of Patent: Nov. 15, 2022

(54) MULTI-USE UTILITY SLEEVE

(71) Applicant: Paul Steven Kitzer, Saint Augustine, FL (US)

(72) Inventor: Paul Steven Kitzer, Saint Augustine, FL (US)

( * ) Notice: Subject to any disclaimer, the term of this patent is extended or adjusted under 35 U.S.C. 154(b) by 0 days.

(21) Appl. No.: 17/328,516

(22) Filed: May 24, 2021

(65) Prior Publication Data

US 2021/0361056 A1 Nov. 25, 2021

Related U.S. Application Data

(60) Provisional application No. 63/029,147, filed on May 22, 2020.

(51) Int. Cl.

| | |
|---|---|
| ***A45F 5/02*** | (2006.01) |
| ***A44C 5/00*** | (2006.01) |
| *A45F 5/00* | (2006.01) |

(52) U.S. Cl.

CPC ..... *A45F 5/02* (2013.01); *A44C 5/0007* (2013.01); *A45F 2005/008* (2013.01); *A45F 2200/0516* (2013.01)

(58) Field of Classification Search

CPC ... A45F 2005/008; A44C 5/0007; F16F 1/025

USPC ..... 224/219, 222

See application file for complete search history.

(56) References Cited

U.S. PATENT DOCUMENTS

| | | | | |
|---|---|---|---|---|
| 4,826,059 | A * | 5/1989 | Bosch | A45C 11/24 211/DIG. 1 |
| 6,000,366 | A * | 12/1999 | Reeping | A61D 9/00 119/850 |
| 7,048,162 | B2 * | 5/2006 | Frye | B25H 3/00 224/222 |
| 7,168,601 | B2 * | 1/2007 | Goodhue | A45F 5/00 206/347 |
| 9,143,854 | B2 * | 9/2015 | Alao | H04R 5/0335 |
| 9,668,550 | B2 * | 6/2017 | Seo | A44C 5/08 |
| 9,844,252 | B2 * | 12/2017 | Kraszewski | A45D 2/127 |
| 11,122,921 | B2 * | 9/2021 | Heit | A47G 23/0266 |
| 2006/0166720 | A1 | 7/2006 | Dixon | |
| 2007/0083979 | A1 | 4/2007 | Daniels | |
| 2009/0321483 | A1 | 12/2009 | Froloff | |
| 2012/0255978 | A1 | 10/2012 | Williams | |
| 2014/0374451 | A1 | 12/2014 | Coleman | |
| 2015/0288407 | A1 | 10/2015 | Hernandez | |
| 2015/0318885 | A1 | 11/2015 | Earle | |
| 2016/0213134 | A1 | 7/2016 | King | |
| 2017/0049628 | A1 * | 2/2017 | Stevens | A61F 13/00038 |

(Continued)

FOREIGN PATENT DOCUMENTS

CA 2819881 7/2013

*Primary Examiner* — Adam J Waggenspack

(74) *Attorney, Agent, or Firm* — Marks Gray, P.A.; Mitchell Ghaneie; Christopher Roberts

(57) ABSTRACT

This invention relates to a wearable adaptative multi-use utility sleeve that enables quick, convenient, and tenacious securement of the multi-use utility sleeve to a person's appendage or torso while also allowing for the swift and convenient attachment and detachment of one or more handheld items to the utility sleeve. The present invention offers several embodiments, each of which utilize a plurality of bistable ribbons, that allow for a one-size-fits-all design that provides the ability to conform to the user's body.

18 Claims, 12 Drawing Sheets

(56) References Cited

U.S. PATENT DOCUMENTS

2019/0335544 A1* 10/2019 Schultz ..... H05B 1/0252
2019/0335883 A1* 11/2019 Fisher ..... A45F 5/102

* cited by examiner

MULTI-USE UTILITY SLEEVE

CROSS-REFERENCE TO RELATED APPLICATIONS

This application claims priority of U.S. patent application Ser. No. 63,029,147, filed on May 22, 2020.

BACKGROUND OF THE INVENTION

A. Field of the Invention

The present invention provides an adaptative multi-use utility sleeve that enables quick, convenient, and tenacious securement of the utility sleeve to a person's appendage or torso while also allowing for the swift and convenient attachment and detachment of a variety of items to the utility sleeve.

B. Prior Art

There are many situations when storing one or more handheld items in a pocket of an article of clothing may not be preferable or even possible. Furthermore, storing one or more handheld items with handbags, backpacks, and the like are often undesirable or inconvenient. The wearable sleeves known within the prior art are often difficult and cumbersome to attach or fail in providing adequate structural support for securing an electronic communication device or other item. Other wearable sleeves are often limited by design to only allow for securing a specific individual handheld item or to only integrate with a specific electronic device. However, the present invention aims to solve these issues by providing an adaptive multi-use utility sleeve that is versatile and allows for quick attachment, reliable securement, a variety of configurations, and a secure compact folding mechanism for easy storage when it is not in use.

BRIEF SUMMARY OF THE INVENTION

The present invention provides several embodiments of an adaptive multi-use utility sleeve that enables quick and secure attachment to a person's appendage or torso and allows for the convenient securement of one or more handheld items. The quick and secure attachment to a person's appendage or torso of adaptive multi-use utility sleeve, hereinafter referred to as the "utility sleeve", is accomplished by cleverly integrating a plurality of strips of hook material, a plurality of strips of loop material, and a plurality of bistable ribbons.

Several embodiments of the utility sleeve are provided. It is anticipated that each embodiment of the utility sleeve may be worn or attached to another object in a folded or unfolded configuration.

The utility sleeve comprises an interior surface and an exterior surface. The interior and exterior surfaces are comprised of one or more layers of fabric. The interior and exterior surfaces are further comprised of a plurality of sections and a variety of materials that are designed to enhance the adaptive functionality of the utility sleeve. The plurality of sections may comprise primary and secondary sections. Each section of the plurality of sections comprises a plurality of boundaries. Each primary section comprises one or more layers of fabric that secure to one or more metal ribbons. Each secondary section comprises one or more layers of fabric. It is preferable to provide at least one secondary section between adjacent primary sections. The interior surface further provides a first end loop strip. The first end loop strip provides a loop material that is used to assist in securing the closure of the utility sleeve when it is worn in an unfolded configuration.

Each bistable ribbon is in a state of static equilibrium when either in an elongated straightened position or a curled position. When sufficient compressive stresses are applied to the bistable ribbon while it is in its elongated straightened position, it eventually reaches a critical stress that results in a snap-through buckling mode of instability which activates a geometric transition of the bistable ribbon to the curled position. The transition between the elongated straightened position is nearly instantaneous.

Each primary section secures at least one bistable ribbon. The bistable ribbons provided by the utility sleeve are flexurally coupled to one another such that the transition between states of static equilibrium of each bistable ribbon occur contemporaneously.

Providing secondary sections between the primary sections enables the utility sleeve to be folded onto itself in such a way that allows in the bistable ribbons being stacked and longitudinally aligned. The folded configuration of the utility sleeve provides for a more concentrated clasping force provided by the bistable ribbons during the geometric transition from their elongated straightened position to the curled position. As a result, when the utility sleeve is worn in the folded configuration it latches onto a user with a greater clasping force and improves its resistance to slippage around the body part which it is secured to.

NUMBERING REFERENCE

Figure 1:
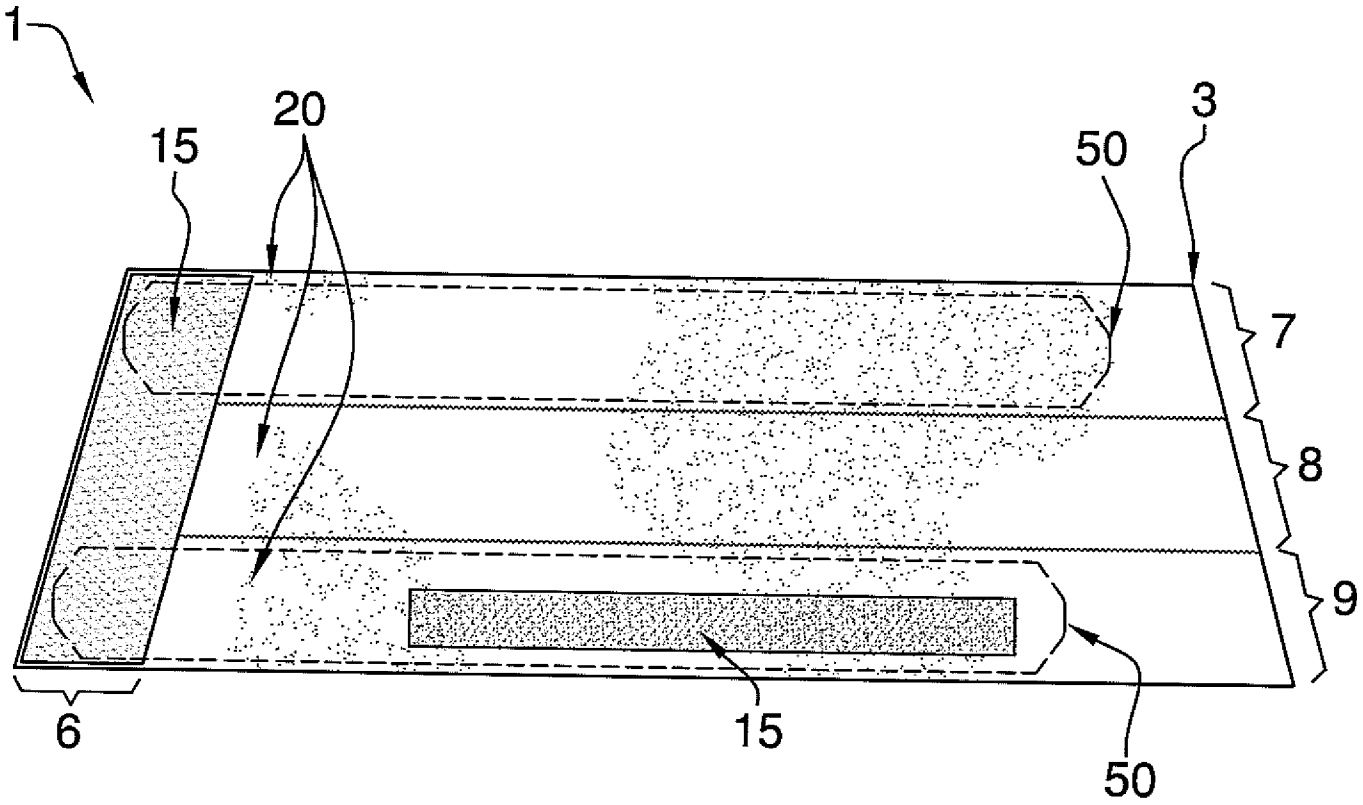
FIG. 1 is a top view of a first embodiment which shows an interior surface of an adaptive multi-use utility sleeve in an unfolded configuration.

1—Adaptive multi-use utility sleeve
3—Interior surface
4—Exterior surface
6—First end loop strip
7—First primary section
8—First secondary section
9—Second primary section
10—Second secondary section
11—Third primary section
15—Loop material
20—Fabric
25—Hook material
50—Bistable ribbons
60—Intermediary coupler
70—Securement tab
100—Second embodiment of the adaptive multi-use utility sleeve
200—Third embodiment of the adaptive multi-use utility sleeve

DETAILED DESCRIPTION OF THE EMBODIMENTS

The present invention provides an adaptive multi-use utility sleeve 1 that enables quick and secure attachment to a variety of areas on a user's body or other objects and allows for the convenient securement of one or more handheld items. The quick and secure attachment of the adaptive multi-use utility sleeve 1, hereinafter referred to as the "utility sleeve 1", to the user's appendage or torso is accomplished by cleverly integrating a plurality of strips of hook material 25, a plurality of strips of loop material 15, and a plurality of bistable ribbons 50. Each bistable ribbon 50 has an elongated rectangular profile with rounded corners and comprises a first end and a second end.

The utility sleeve 1 has a polygonal profile and comprises a first end, a second end, a top end, and a bottom end. Preferably, the polygonal profile is trapezoidal to more effectively accommodate a tapered cross-section of the user's appendage. The top and bottom ends are parallel to one another. The utility sleeve 1 further comprises an interior surface 3 and an exterior surface 4. The interior and exterior surfaces 3, 4 are comprised of one or more layers of fabric 20.

The interior and exterior surfaces 3, 4 further comprise a plurality of sections. The plurality of sections comprises at least two primary sections. The at least two primary sections comprise a first primary section 7 and a second primary section 9. The plurality of sections may further comprise at least one secondary section. The at least one secondary section comprises a first secondary section 8. The interior surface 3 also comprises a first end loop strip 6.

Figure 2:
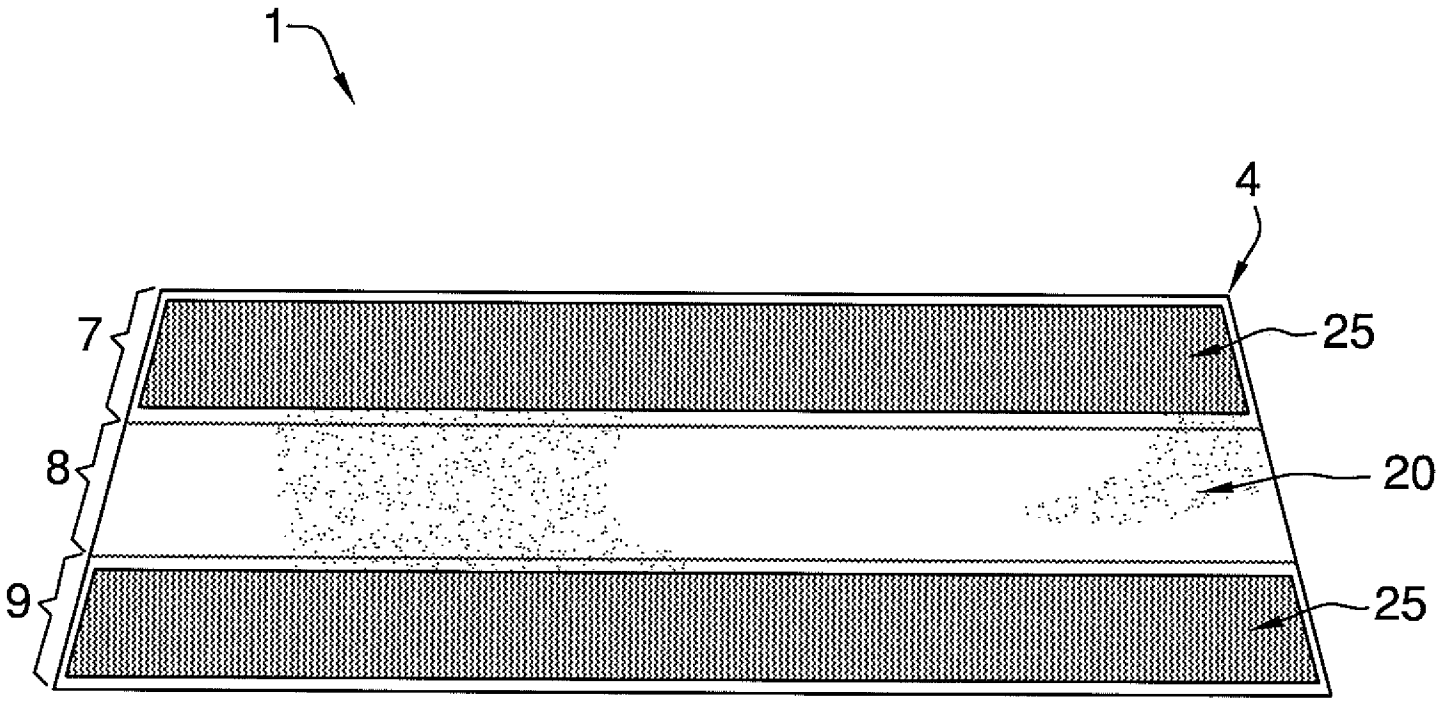
FIG. 2 is a bottom view of the first embodiment which shows an exterior surface of the adaptive multi-use utility sleeve in the unfolded configuration.
Figure 9:
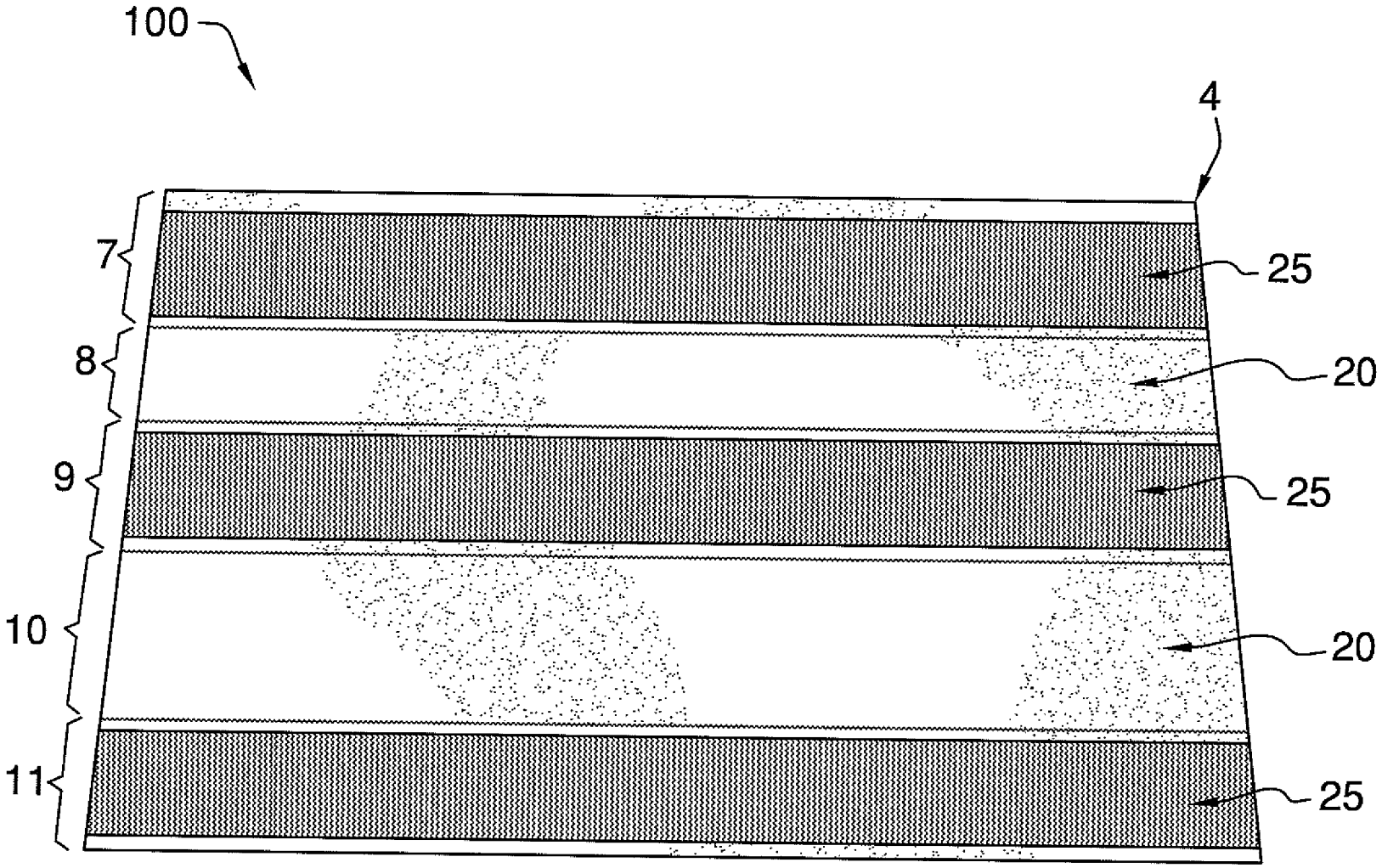
FIG. 9 is a top view of the exterior surface of the second embodiment of the adaptive multi-use utility sleeve in the unfolded configuration.

Preferably, the interior and exterior surfaces 3, 4 are attached to each other with two or more layers of fabric 20; one layer of fabric 20 providing interior surface 3, and another layer of fabric 20 providing the exterior surface 4. As shown in FIGS. 2 and 9, each section of the plurality of sections is formed by a plurality of boundaries. The plurality of boundaries includes one or more interior boundaries. As shown in FIGS. 2 and 9, the jagged lines exemplify the interior boundaries which separate adjacent sections from one another. The two or more layers of fabric 20 are attached to one another along each interior boundary of the one or more interior boundaries. The attachment of the two or more layers of fabric 20 along each interior boundary reduces the distance between the interior and exterior surfaces 3, 4. Consequently, such attachment of the two or more layers of fabric 20 promotes pivotal rotation of respectively adjacent sections about their shared interior boundary.

An example of adjacent sections pivotally rotating about their shared interior boundaries is exemplified in FIG. 4 wherein the first primary section 7 initially pivots about the interior boundary that it shares with the first secondary section 8 and then subsequently the first secondary section 8 pivotally rotates about its other interior boundary that it shares with the second primary section 9.

Alternatively, it is anticipated that one layer of fabric 20 can provide both the interior surface 3 and exterior surface 4. A cavity, which is formed by the void between the interior and exterior surfaces 3, 4, is provided within each section of the plurality of sections. The cavity has a depth that is equal to or greater than the thickness of the bistable ribbon 50. Furthermore, it is preferable that each cavity has a width that is substantially equal to the width of the bistable ribbon 50 and a length that is greater than the length of the bistable ribbon 50.

Accordingly, each primary section may secure at least one bistable ribbon 50 by substantially encasing the at least one bistable ribbon 50 within the cavity of the primary section. When one or more of the plurality of bistable ribbons 50 are secured by encasement within the cavity of the primary section, the first end of each encased bistable ribbon 50 is offset from the first end of the utility sleeve 1 by a gap. Preferably, the gap has a length substantially equal to one eighth of an inch (⅛"). However, it is anticipated that the length of the gap may vary and that the first end of each bistable ribbon 50 may connect to the first end of the utility sleeve 1. Also, it is anticipated that the one or more bistable ribbons 50 encased within each cavity of each primary section may longitudinally translate within the cavity, thereby resulting in the length of the gap to vary. It is further anticipated that each primary section may secure one or more bistable ribbons 50 using other mechanisms of attachment, including, but not limited to, adhesion or partial encasement.

Figure 3:
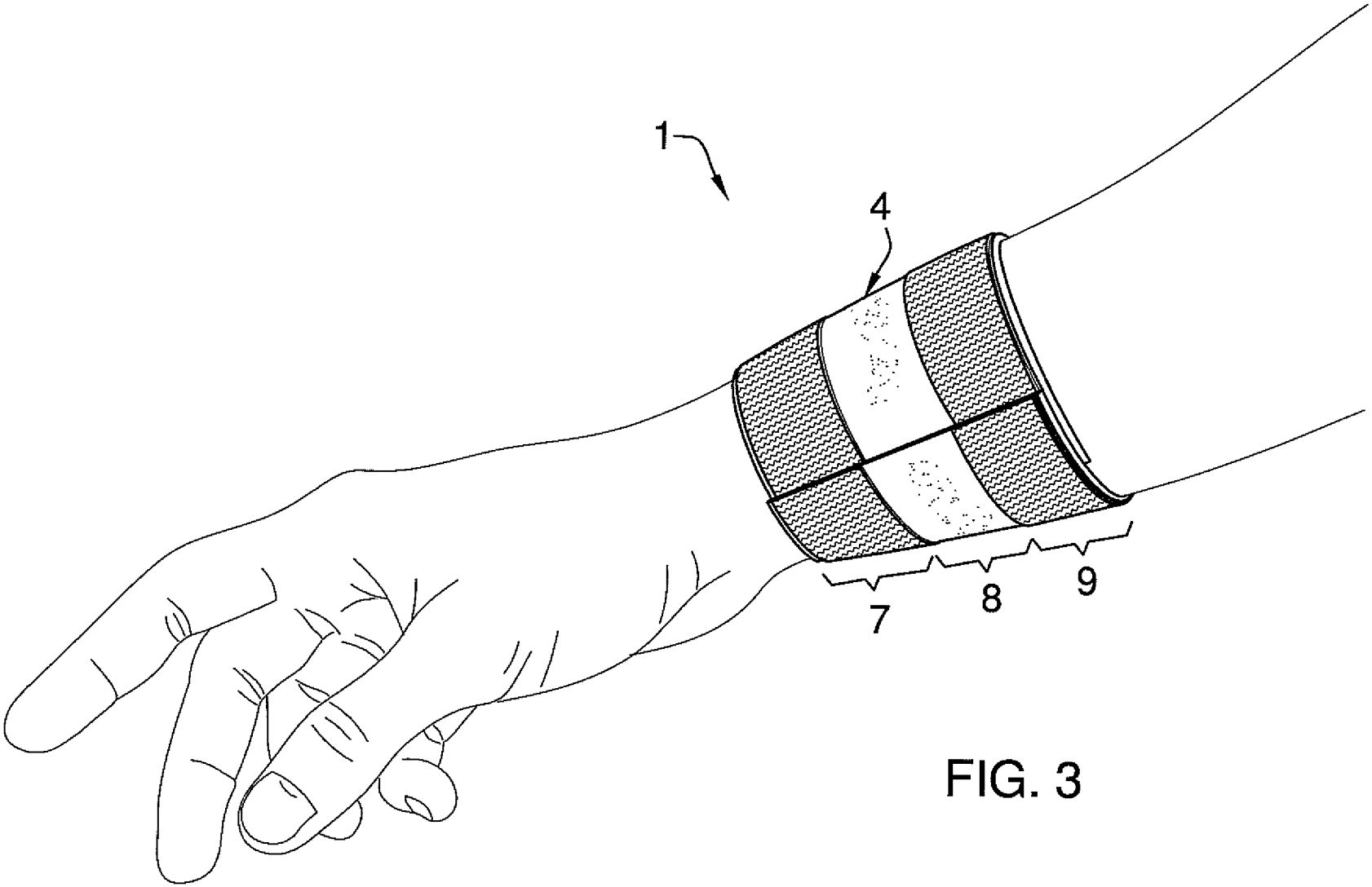
FIG. 3 is an isometric in-use view of the first embodiment of the adaptive multi-use utility sleeve being worn in the unfolded configuration.
Figure 7:
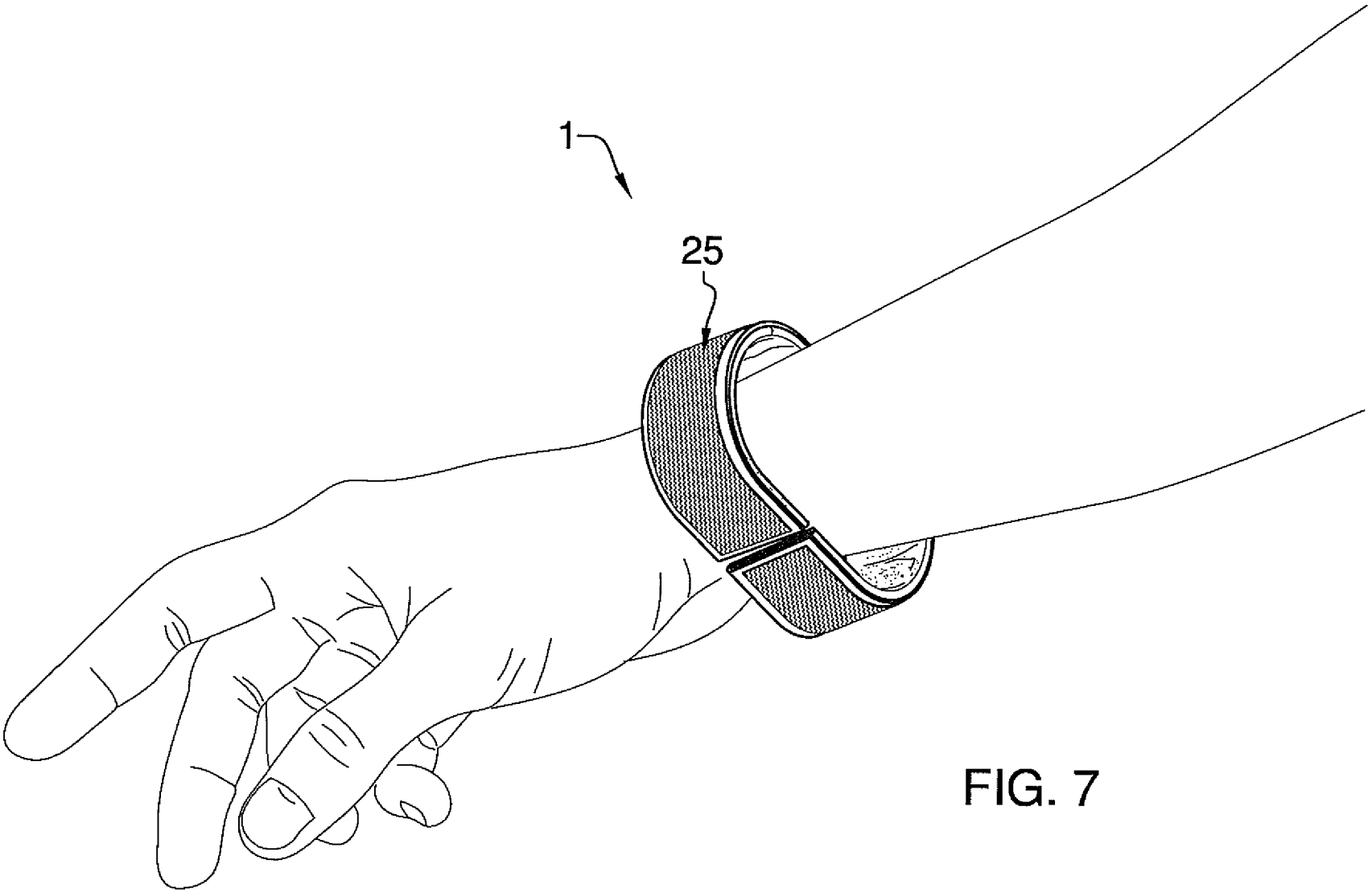
FIG. 7 is an in-use isometric view of the first embodiment of the adaptive multi-use utility sleeve being worn in its folded configuration.
Figure 10:
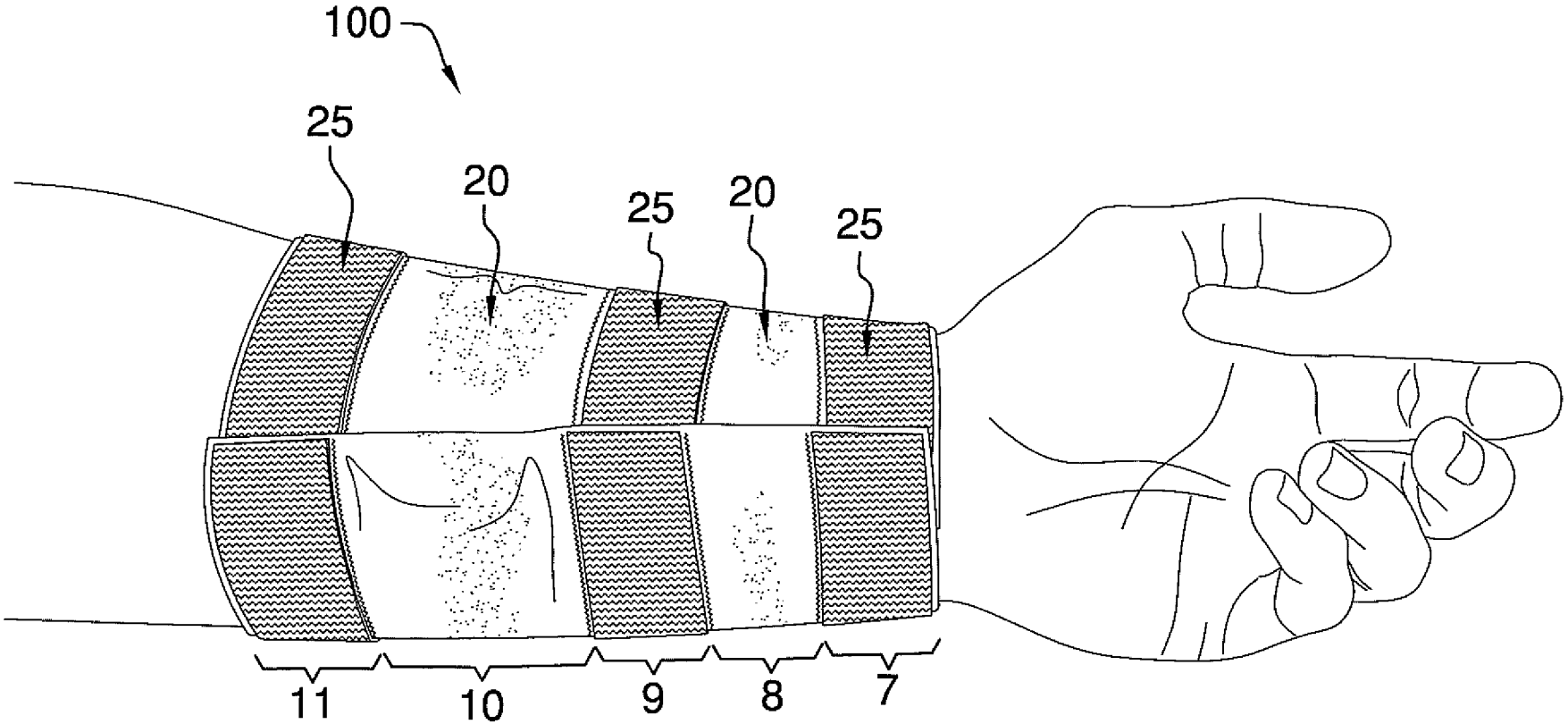
FIG. 10 is an in-use isometric view of the second embodiment of the adaptive multi-use utility sleeve being worn in the unfolded configuration.
Figure 12:
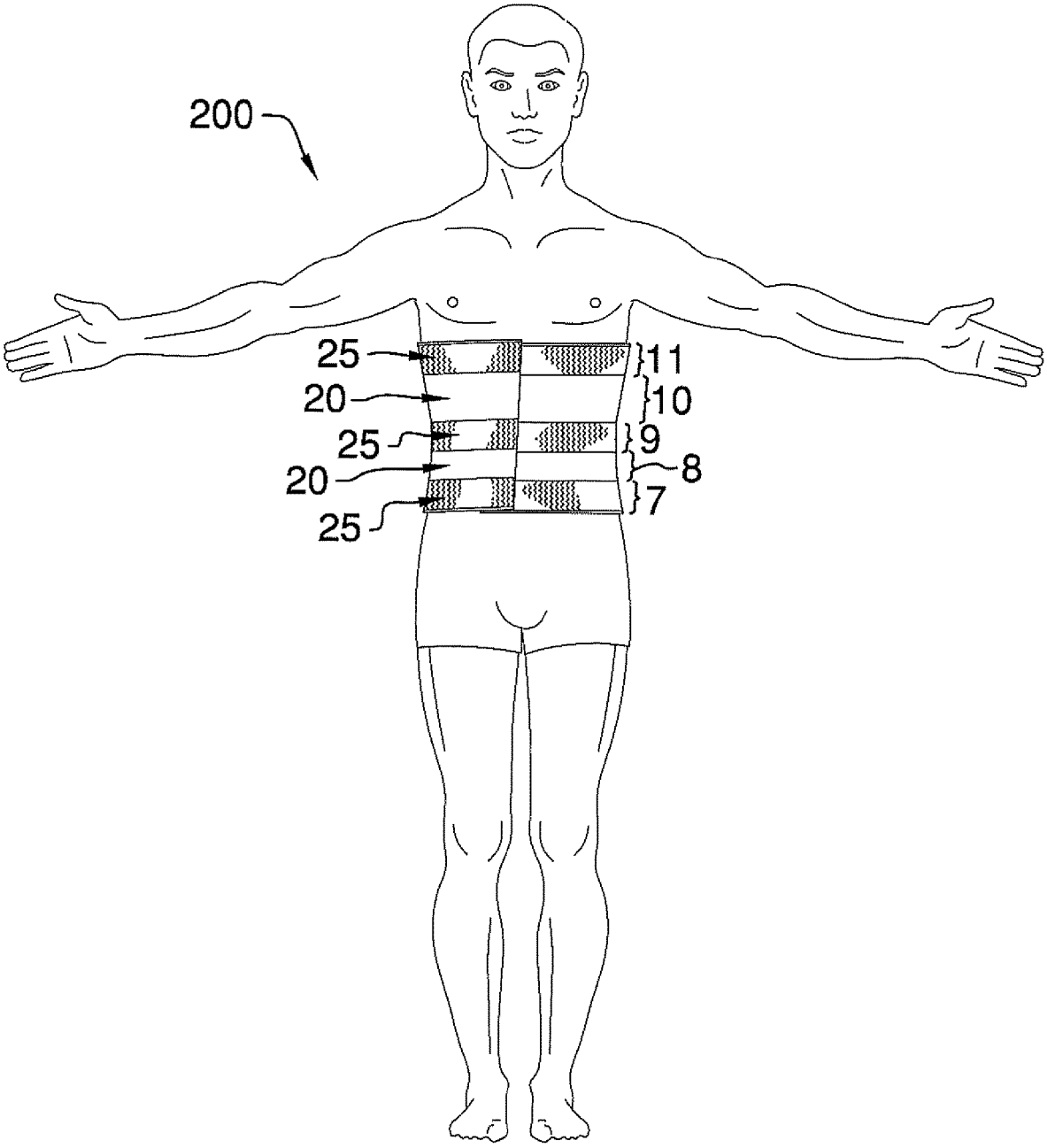
FIG. 12 is an in-use isometric view of the third embodiment of the adaptive multi-use utility sleeve being worn around the torso of the user in the unfolded configuration.

A clever utilization of the plurality of hook and loop materials 15, 25 in combination with the plurality of bistable ribbons 50 allow the utility sleeve 1 to be worn in a folded configuration, as shown in FIG. 7, or an unfolded configuration, as shown in FIGS. 3, 10, 12. The bistable ribbons 50 are preferably made from a metal alloy. However, it is anticipated that the bistable ribbons 50 may be made from an alternative material, such as, but not limited to, a plastic or a fiber reinforced polymer (such as CFRP). Additionally, it is preferrable that the bistable ribbons 50 are all of a substantially equal length.

Each primary section additionally provides a strip of hook material 25 on the exterior surface 4. Each strip of hook material 25 is used to attach to the loop material 15 of the first end loop strip 6 when the utility sleeve 1 is worn in the unfolded configuration, as shown in FIG. 3. Each strip of hook material 25 provided by each primary section may also be used to attach one or more handheld items to the utility sleeve 1.

Figure 8:
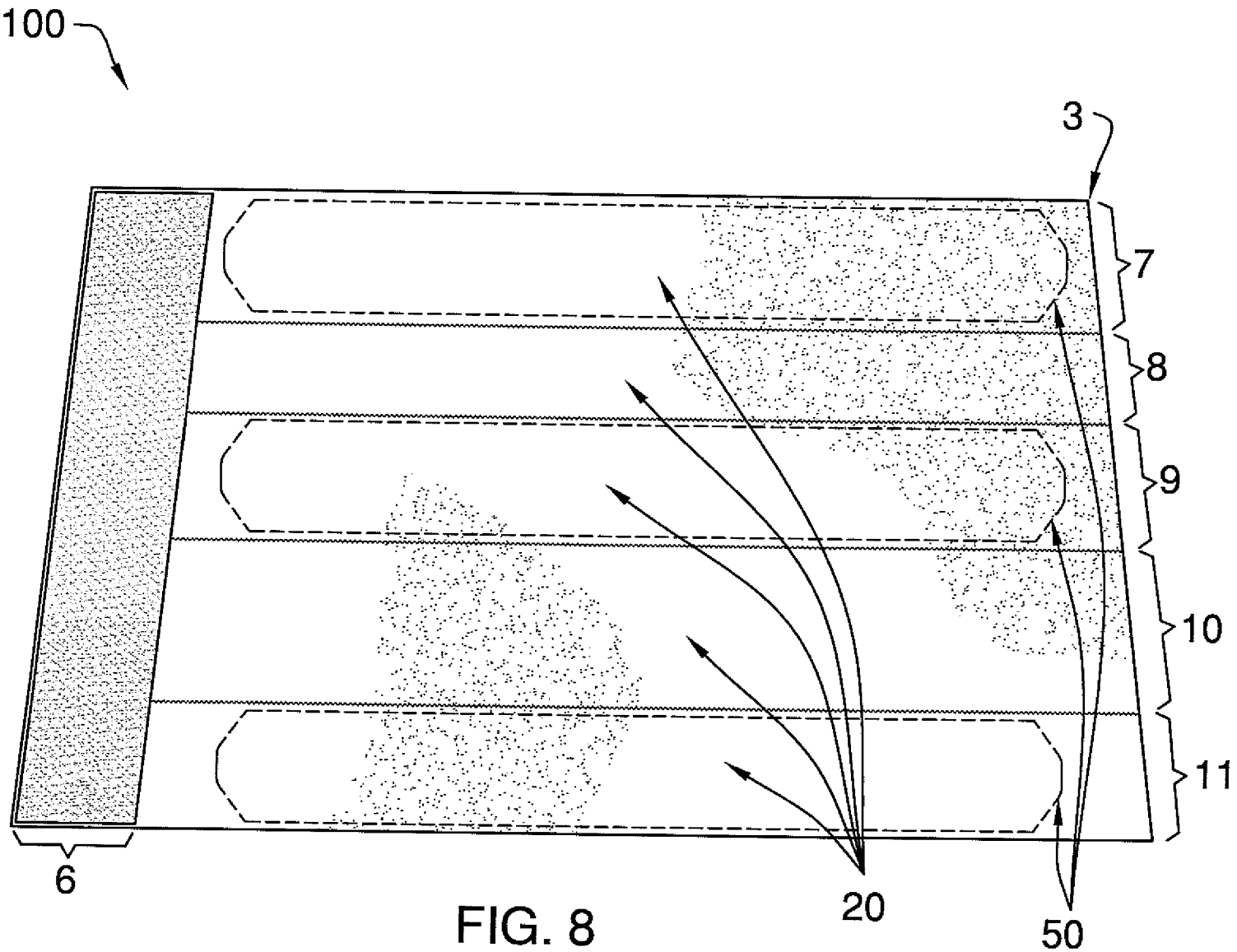
FIG. 8 is a bottom view of the interior surface of a second embodiment of the adaptive multi-use utility sleeve in an unfolded configuration.
Figure 11:
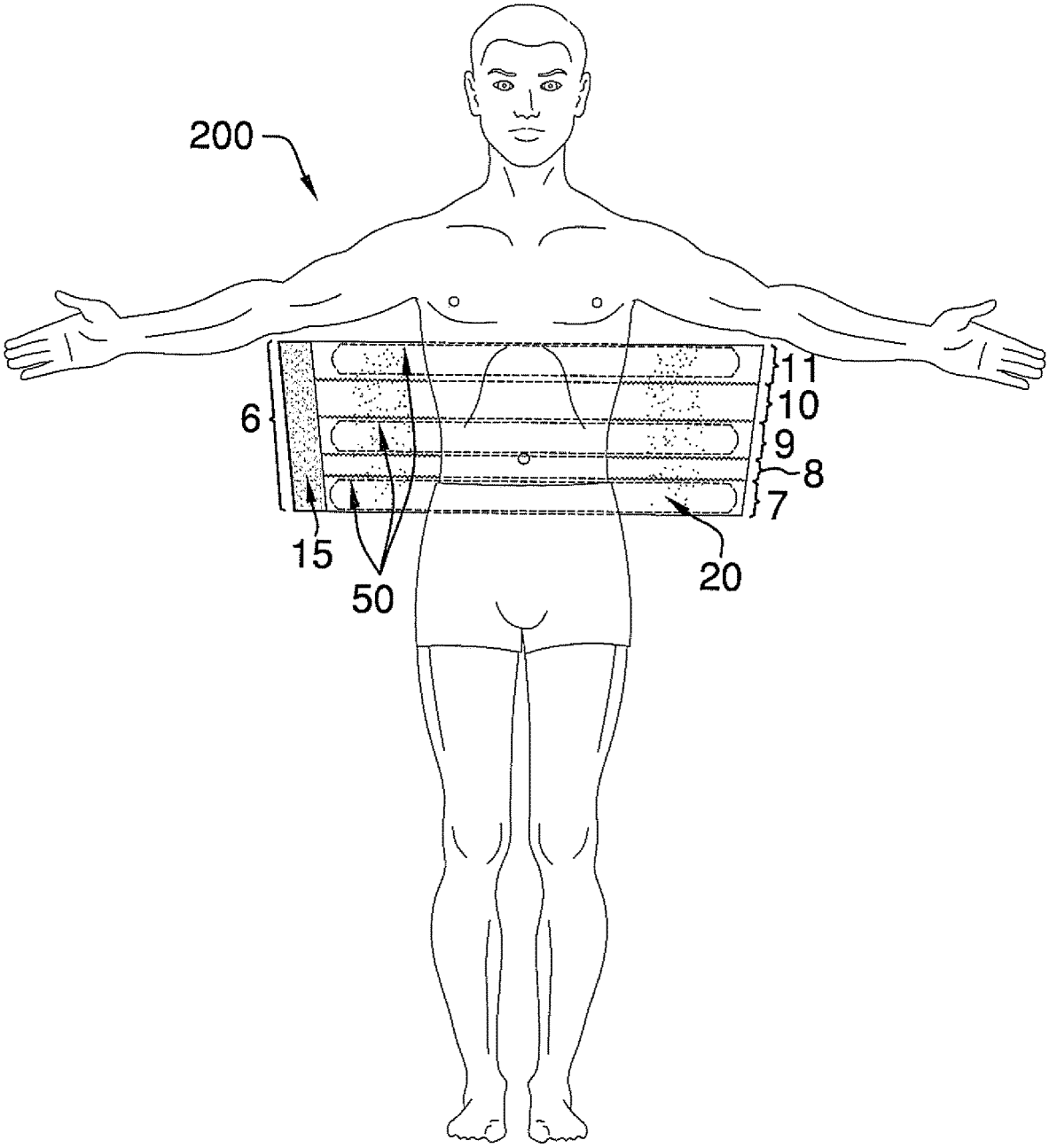
FIG. 11 is an elevation side view showing the interior surface of a third embodiment of the adaptive multi-use utility sleeve positioned behind a torso of a user in an unfolded configuration.

The first end loop strip 6 is positioned substantially adjacent to the first end of the utility sleeve 1 and overlaps across the plurality of sections, as shown in FIGS. 1, 8, and 11. The first end loop strip 6 provides a strip of the loop material 15 on the interior surface 3 that is used to assist in securing the closure of the utility sleeve 1 when it is worn in the unfolded configuration, as shown in FIGS. 3, 10, and 12.

Figure 6:
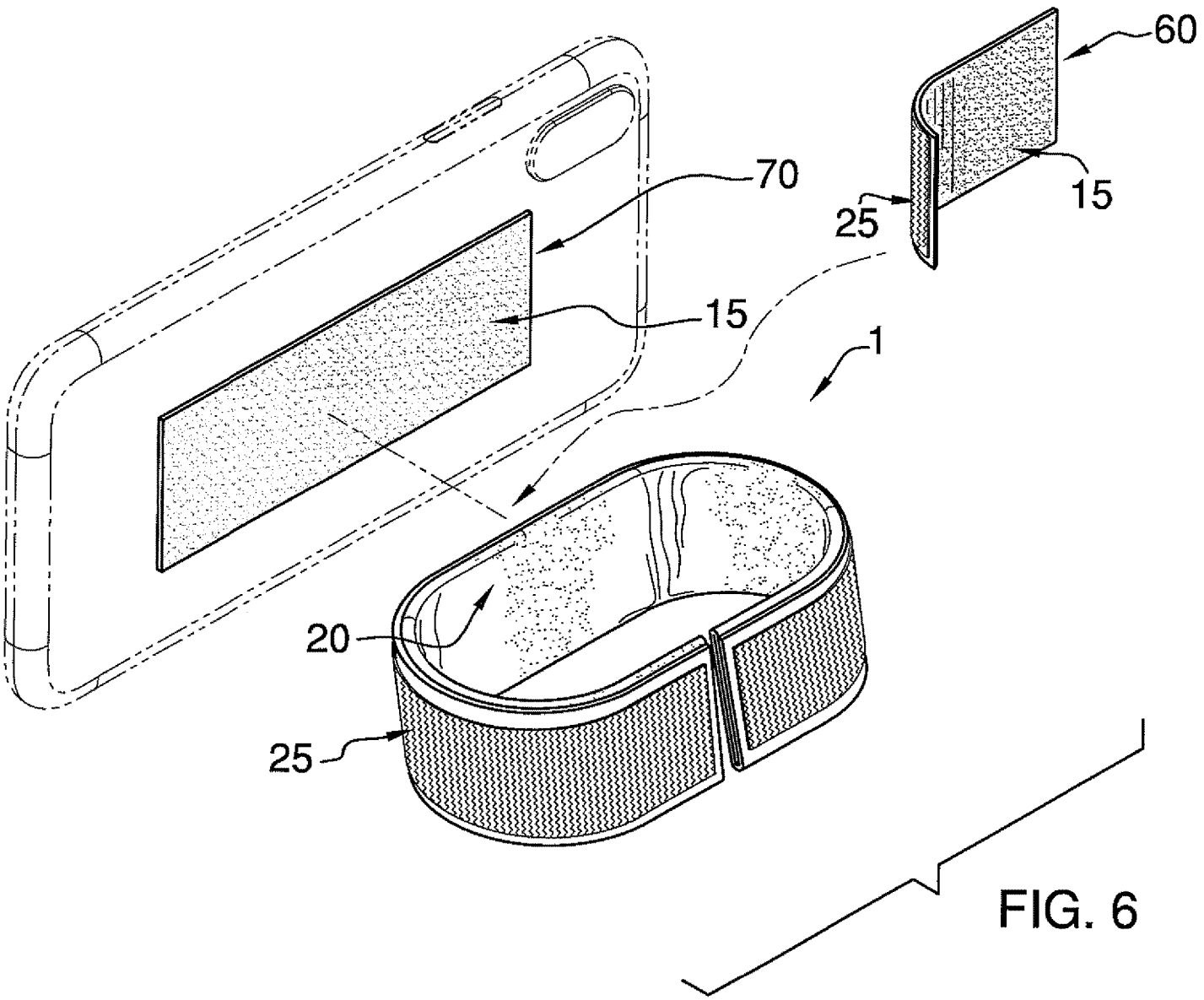
FIG. 6 is an isometric view of the first embodiment showing how the adaptive multi-use utility sleeve in the folded configuration can attach directly to a handheld device, via a securement tab, or indirectly via an intermediary coupler.

With reference to a first embodiment of the utility sleeve 1, as shown in FIG. 6, the utility sleeve 1 is designed to quickly and securely attach to one or more handheld items by attaching a securement tab 70 to each handheld item. The securement tab 70 provides two surfaces. The two surfaces comprise an adhering surface and a latching surface. The adhering surface provides an adhesive strip which is used to adhere the securement tab 70 to a surface of the handheld item. The latching surface provides an attachment mechanism. The attachment mechanism may comprise a variety of materials that allow the utility sleeve 1 to quickly attach to and detach from the securement tab 70. As shown in FIG. 6, the latching surface of the securement tab 70 may comprise a loop material 15 which may be used to attach to hook material 25 on the exterior surface 4 of the utility sleeve 1.

It is anticipated that each bistable ribbon 50 may be removable to allow for replacement or cleaning. Providing access to the one or more bistable ribbons 50 that are fully encased within each cavity of each primary section also enables the user to customize the clasping strength of the utility sleeve 1 by allowing for supplemental bistable ribbons 50 to be added within one or more cavities. Increasing the clasping strength of the utility sleeve 1 is advantageous when the user desires to attach heavy handheld items to the utility sleeve 1 or when the user is intending to wear the utility sleeve 1 during vigorous physical activities.

Figure 4:
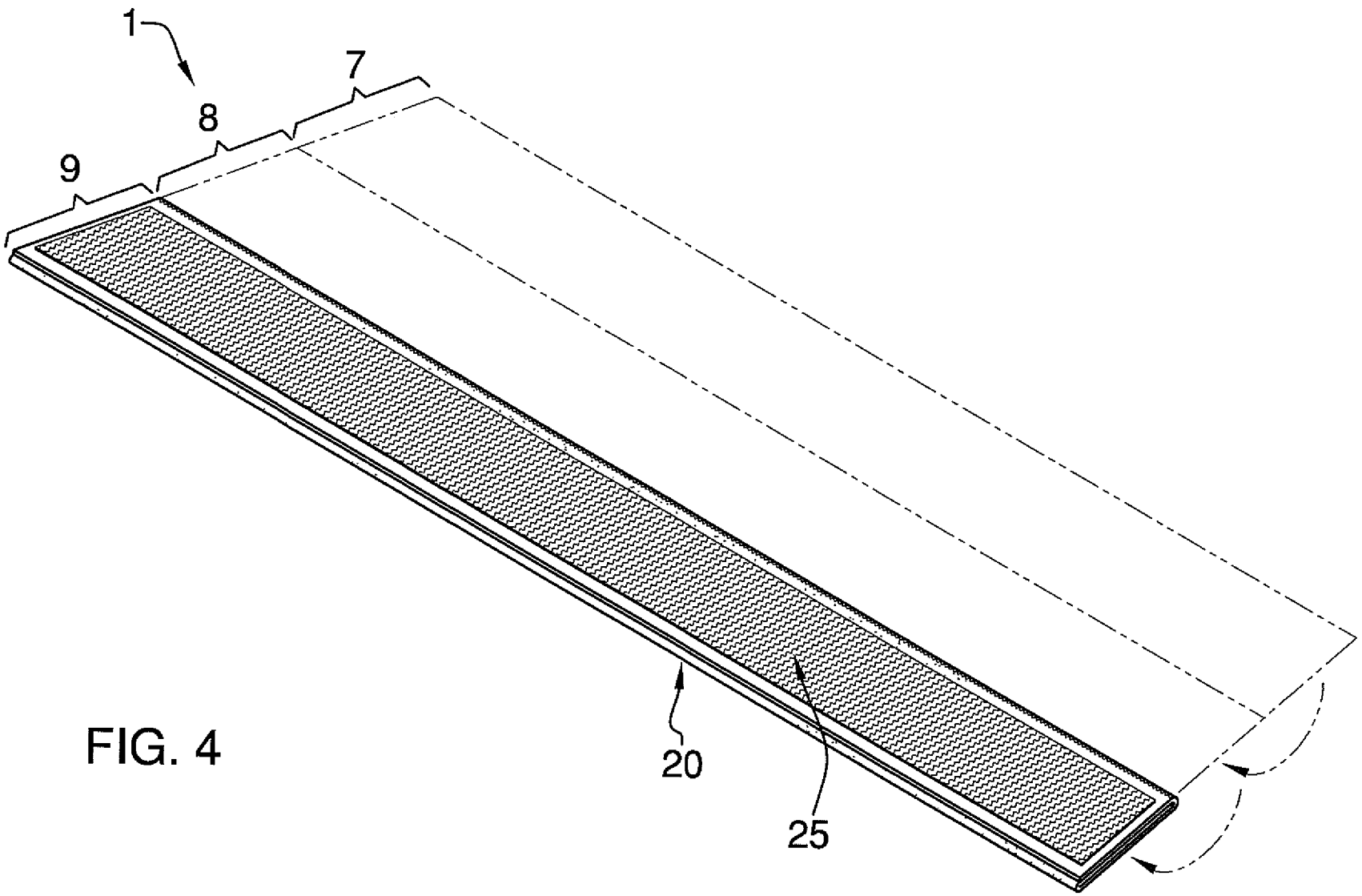
FIG. 4 is an isometric view of a folding process used to transform the first embodiment of the adaptive multi-use utility sleeve from the unfolded configuration to a folded configuration.
Figure 5:
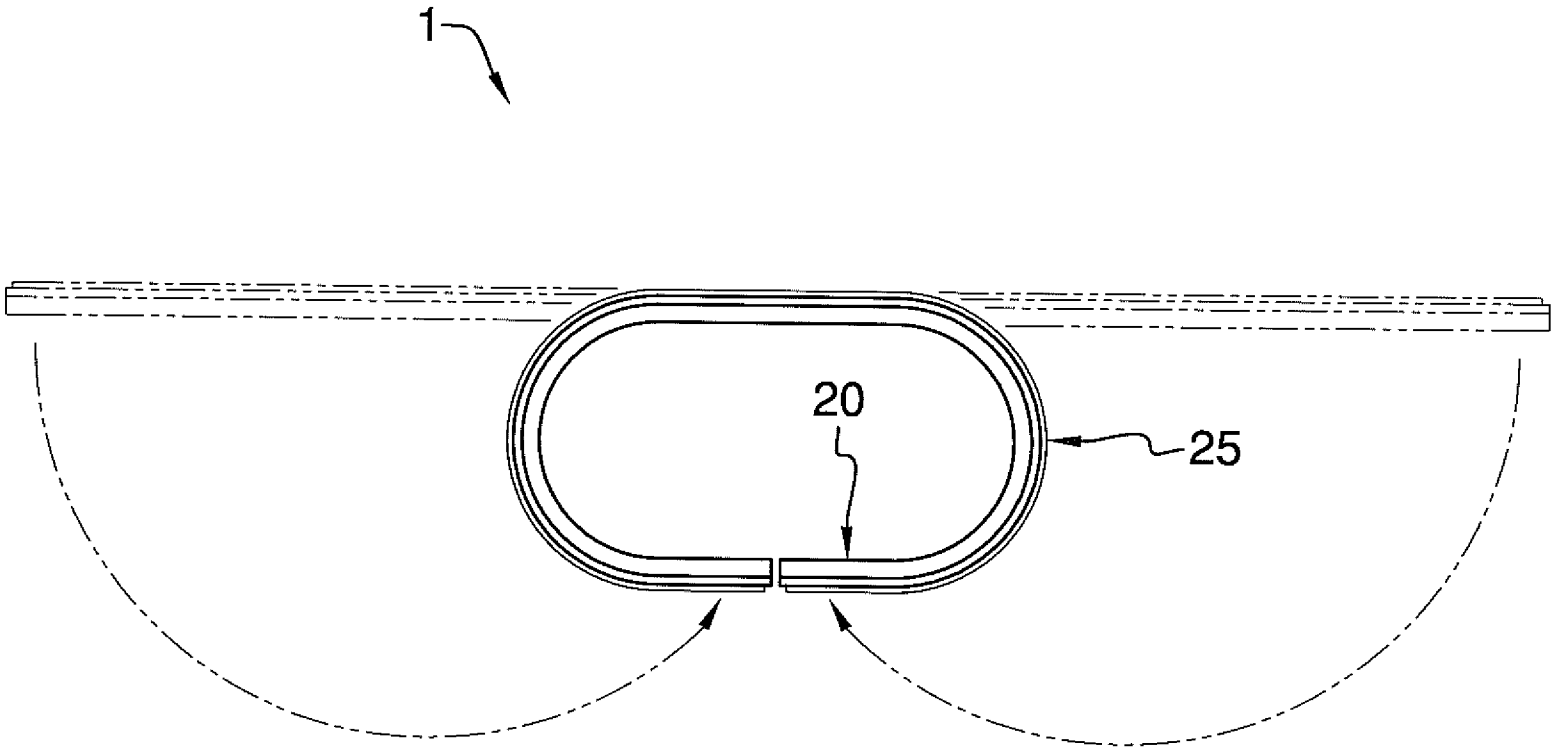
FIG. 5 is a side view of the first embodiment of the adaptive multi-use utility sleeve in the folded configuration transitioning from an elongated straightened position to a curled position.

The fabric 20 must be flexible in order to adequately fold into the folded configuration, as shown in FIG. 4, as well as adequately bend into the curled position, as shown in FIG. 5. Additionally, the fabric 20 is preferably tear resistant. It is anticipated that the fabric 20 could be comprised of a variety of natural or synthetic fibers. Synthetic materials such as polyparaphenylene terephthalamide may comprise the fabric and provide the user with added protective benefits.

Providing secondary sections 8 between the primary sections 7 improves the longitudinal alignment of the stacked bistable ribbons 50 when the utility sleeve 1 is worn or attached in the folded configuration, as shown in FIG. 7. However, it is anticipated that the utility sleeve 1 may be designed without any secondary sections 8 (not shown) or with two or more primary sections 7 configured directly adjacent to one another (not shown). The longitudinal alignment of the stacked bistable ribbons 50 improves the user's comfort and compactness of the utility sleeve 1 when the utility sleeve 1 is worn in the folded configuration, as shown in FIG. 7. The folded configuration of the utility sleeve 1 provides for a more concentrated clasping force when the utility sleeve 1 geometrically transitions from the elongated straightened position, as shown in FIGS. 1, 2, 4, 8, 9 and 11, to the curled position, as shown in FIGS. 3, 5, 6, 7, 10, and 12.

It is also anticipated that the utility sleeve 1 could further comprise an intermediary coupler 60. The intermediary coupler 60 provides a first side and a second side. The first side provides a strip of hook material 25 and the second side provides a strip of loop material 15. The intermediary coupler 60 attaches to the securement tab 70 on its first side and to the exterior surface 4 of the utility sleeve 1 on its second side. The intermediary coupler 60 may be comprised of a flexible or rigid material.

Additionally, it is further anticipated that at least one additional strip of loop material 15 may be provided on the interior surface of at least one primary section, as shown in FIG. 1. The at least one additional strip of loop material 15 assists the utility sleeve 1 in maintaining its folded configuration during use as well as when it is desirable to store the utility sleeve 1 in the folded configuration.

It is also anticipated that the bistable ribbons 50 could be magnetized such that they are magnetically attracted to one another. The use of magnetized bistable ribbons 50 would allow for quick modular supplementation of one or more additional bistable ribbons 50 if at least one magnetized bistable ribbon 50 were encased within the cavity of each primary section.

Each bistable ribbon 50 is in a state of static equilibrium when either in an elongated straightened position or a curled position. When the utility sleeve 1 is in the elongated straightened position it is in a state of unstable static equilibrium, relative to the geometric stability of the curled position. Inducing compressive stresses of increasing magnitude about the longitudinal axis of the bistable ribbon 50 while it is in the elongated straightened position will eventually result in a snap-through buckling mode of instability that activates the geometric transition of the bistable ribbon 50 to its statically stable curled position.

The geometric transition of the bistable ribbon 50, and consequently the utility sleeve 1, from the elongated straightened position to the curled position may occur nearly instantaneously. When the bistable ribbons 50 are in the curled position they are resistant to return to the elongated straightened position. These positional stabilities are leveraged to improve the speed and ease at which the utility sleeve 1 is secured to the user's body, while also assisting in the resistance of the utility sleeve 1 from being dislodged during use. Furthermore, each bistable ribbon 50 is flexurally coupled to the other bistable ribbons 50 by the fabric 20 which they are secured to.

Several alternate embodiments of the utility sleeve 1 are anticipated and shown in FIGS. 8-12.

A second embodiment of the adaptive multi-use utility sleeve 100, hereinafter referred to as the "second embodiment" 100, comprises of all of the constituents that the first embodiment provides as well as a second secondary section 10 and a third primary section 11. The second embodiment 100 allows for securing handheld items of increased quantity, size, or weight. The second embodiment 100 could be secured to any appendage on the user's body, such as an arm as shown in FIG. 10. The second embodiment 100 may be worn in the folded or unfolded configuration.

A third embodiment of the adaptive multi-use utility sleeve 200, hereinafter referred to as the "third embodiment" 200, provides an enlarged profile to allow for securement to the torso, as shown in FIGS. 11 and 12. In certain situations, it may be advantageous to be able to quickly secure and conceal one or more handheld items, such as a mobile device, outdoor gear, firearms, firearm accessories, or a wallet, beneath a shirt or article of clothing. It is anticipated that the third embodiment 200 may be worn in the folded or unfolded configuration.

It is also anticipated that alternative attachment technologies, such as, but not limited to, electromagnetism, could be used with or in place of the hook and loop materials 15, 25 for any embodiment of the present invention. Magnets of varying size, shape, and strength would allow for attaching to various handheld items. It is further anticipated that using electromagnetism in place of or in combination with the hook and loop materials 15, 25 may increase the clasping force during the geometric transition of the utility sleeve 1.

While the embodiments of the invention have been disclosed, certain modifications may be made by those skilled in the art to modify the invention without departing from the spirit of the invention.

The inventor claims:

1. A multi-use utility sleeve comprising:

a. a first end;

b. a second end;

c. a folded configuration;

d. an unfolded configuration;

e. a plurality of bistable ribbons;

wherein each bistable ribbon has a first end and a second end;

f. an interior surface and an exterior surface;

wherein the interior surface and exterior surface each comprise a layer of fabric;

wherein the interior surface and exterior surface further comprise a plurality of sections;

wherein the plurality of sections comprises at least two primary sections and at least one secondary section;

wherein each primary section provides a strip of hook material on the exterior surface;

wherein each primary section secures at least one of the plurality of bistable ribbons;

wherein each primary section is configured to allow each bistable ribbon which it secures to longitudinally translate;

wherein each section of the plurality of sections comprises a substantially equal width relative to the other sections of the plurality of sections;

wherein each section of the plurality of sections comprises a plurality of boundaries;

wherein the plurality of boundaries of each section comprises one or more interior boundaries;

wherein each layer of fabric is attached to one another along each interior boundary of the one or more interior boundaries;

wherein each section is pivotally configurable about one or more interior boundaries of the one or more interior boundaries which it shares with one or more adjacent sections;

wherein the interior surface further comprises a first end loop strip;

wherein the first end loop strip provides a strip of loop material on the interior surface; and wherein the folded configuration further comprises each section of the plurality of sections overlapping one another such that the longitudinal axis of each bistable ribbon is substantially aligned with the longitudinal axis of each other bistable ribbon.

2. The multi-use utility sleeve of claim 1, wherein the first end loop material attaches to each strip of hook material provided by each primary section when the multi-use utility sleeve is worn in the unfolded configuration.

3. The multi-use utility sleeve of claim 1, wherein the first end of each of the one or more bistable stable ribbons secured by each primary section is offset relative to the first end of the bistable ribbons secured by the one or more other primary sections.

4. The multi-use utility sleeve of claim 1, wherein the folded configuration further comprises each section of the plurality of sections overlapping one another.

5. The multi-use utility sleeve of claim 1, wherein at least one of the primary sections provides a strip of loop material on the interior surface.

6. The multi-use utility sleeve of claim 1, further comprising a securement tab.

7. The multi-use utility sleeve of claim 6, wherein the securement tab is designed for attachment to a handheld item.

8. The multi-use utility sleeve of claim 1, further comprising a polygonal profile.

9. The multi-use utility sleeve of claim 1, further comprising an intermediary coupler.

10. A multi-use utility sleeve comprising:

a. a first end;

b. a second end;

c. a folded configuration;

d. an unfolded configuration;

e. a plurality of bistable ribbons;

wherein each bistable ribbon has a first end and a second end;

f. an interior surface and an exterior surface;

wherein the interior surface and exterior surface each comprise a layer of fabric;

wherein the interior surface and exterior surface further comprise a plurality of sections;

wherein the plurality of sections comprises a plurality of primary sections;

wherein each primary section provides a strip of hook material on the exterior surface;

wherein each primary section secures at least one bistable ribbon of the plurality of bistable ribbons;

wherein each primary section is configured to allow each bistable ribbon which it secures to longitudinally translate;

wherein each section of the plurality of sections comprises a substantially equal width relative to the other primary sections of the plurality of sections;

wherein each section of the plurality of sections comprises a plurality of boundaries;

wherein the plurality of boundaries of each section comprises one or more interior boundaries;

wherein each layer of fabric is attached to one another along each interior boundary of the one or more interior boundaries;

wherein each section of the plurality of sections is pivotally configurable about one or more interior boundaries of the one or more interior boundaries which it shares with one or more adjacent sections;

wherein the interior surface further comprises a first end loop strip;

wherein the first end loop strip provides a strip of loop material on the interior surface; and wherein the folded configuration further comprises each section of the plurality of sections overlapping one another such that the longitudinal axis of each bistable ribbon is substantially aligned with the longitudinal axis of each other bistable ribbon.

11. The multi-use utility sleeve of claim 10, wherein the first end loop material attaches to each strip of hook material provided by each primary section when the multi-use utility sleeve is worn in the unfolded configuration.

12. The multi-use utility sleeve of claim 10, wherein the first end of each of the one or more bistable stable ribbons secured by each primary section is offset relative to the first end of the bistable ribbons secured by the one or more other primary sections.

13. The multi-use utility sleeve of claim 10, wherein the folded configuration further comprises each section of the plurality of sections overlapping one another.

14. The multi-use utility sleeve of claim 10, wherein at least one of the primary sections provides a strip of loop material on the interior surface.

15. The multi-use utility sleeve of claim 10, further comprising a securement tab.

16. The multi-use utility sleeve of claim 10, wherein the securement tab is designed for attachment to a handheld item.

17. The multi-use utility sleeve of claim 10, further comprising a polygonal profile.

18. The multi-use utility sleeve of claim 10, further comprising an intermediary coupler.

* * * * *